United States Patent [19]

Burke

[11] 4,393,988

[45] Jul. 19, 1983

[54] SPOON LID

[76] Inventor: Mary Burke, 2430 Fair Oaks Apt. 187, Sacramento, Calif. 95825

[21] Appl. No.: 283,444

[22] Filed: Jul. 15, 1981

[51] Int. Cl.[3] ..... B65D 43/08; B65D 3/00

[52] U.S. Cl. ..... 229/43; 229/1.5 C

[58] Field of Search ..... 229/43, 1.5 C; 220/85 D; 215/DIG. 5

[56] References Cited

U.S. PATENT DOCUMENTS

| | | | |
|---|---|---|---|
| 1,625,335 | 4/1927 | Schneider | 229/1.5 C |
| 1,657,325 | 1/1928 | Suttle | 229/43 |
| 2,453,393 | 11/1948 | Wilson | 229/43 |
| 2,598,987 | 6/1952 | Franzen | 229/1.5 C |
| 3,722,779 | 3/1973 | Chang . | |
| 3,931,925 | 1/1976 | Ruff . | |
| 4,036,398 | 7/1977 | Hoogvelt . | |
| 4,060,176 | 11/1977 | Tobiasson . | |
| 4,218,010 | 8/1980 | Ruff . | |
| 4,324,343 | 4/1982 | Moller | 229/43 |

FOREIGN PATENT DOCUMENTS

| | | | |
|---|---|---|---|
| 326788 | 3/1930 | United Kingdom | 229/1.5 C |
| 437392 | 10/1935 | United Kingdom | 229/1.5 C |

*Primary Examiner*—Herbert F. Ross

*Attorney, Agent, or Firm*—Blair, Brown & Kreten

[57] ABSTRACT

A combination utensil-lid together providing an integral spoon therewith which includes a lid having substantially planar top and bottom surfaces and a depending perimeter lip adapted to sealingly engage a container, a tab member formed to serve as an eating utensil foldably hinged on the bottom surface of the lid whereby the utensil is adapted to be folded from a stored position parallel to and underlying the bottom lid surface to a deployed position extending beyond the lip, and the lid and hinge formed from a resilient material having a memory whereby the lid and hinge can be respectively deformed and deployed to dispense material within the container with the utensil, and thereafter restored to an original condition for storage of a portion of the material in the container.

7 Claims, 4 Drawing Figures

SPOON LID

BACKGROUND OF THE INVENTION

This invention relates generally to lids used to cover containers having materials therewithin and simultaneously being capable of being formed as a dispensing utensil.

Heretofore people requiring the use of a utensil associated with a container, the contents of which are to be consumed or otherwise dispensed, availed themselves of wooden spoons or the like given as an adjunct to the container. More recently, however, it has been found that a higher degree of efficiency and economies in product packaging could be realized by providing a spoon integral with the container lid itself.

The following U.S. patent reflect the state of the art of which applicant is aware in so far as these patent appear germane to the patent process: Nos.

| | |
|---|---|
| 3,722,770 | Chang |
| 3,931,925 | Ruff |
| 4,036,398 | Hoogvelt et al. |
| 4,060,176 | Tobiasson |
| 4,218,010 | Ruff |

Of these references, the patent to Hoogvelt et al. is of great interest since they teach the use of a container with a removable lid having inner and outer surfaces, the lid being peripherally sealed to the container. A pull ring is secured to the outer surface of the lid and a disposable eating utensil is removably secured to the inner surface of the lid so that in one form of the invention, the eating utensil is capable of dissociation from the lid itself, in another form, the utensil is pivotally disposed away from the lid bottom surface and thereafter the lid portion itself is foldable and deformable to provide a further hand grasping area for the consumer. Clearly, the device as defined hereinabove lends itself to use only when the container lid is formed from metal, an undesirable feature in many instances when the container is to be handled by a child or the like, since lids of this type are susceptible to exposing sharp edges capable of cutting.

The patent to Chang teaches the use of a combination food container and implement for extracting the contents in which the utensil is removably attachable to a bottom surface of a lid my means of slidable disposition within a sheath or the like, and suffers from a concomitant increase in the manufacturing costs therewith when contrasted with the apparatus according to the instant application.

The patent to Tobiasson teaches the use of a food container lid which is converted into a spoon for use in eating from the container in which the flap defining the spoon is separable from the remainder of the lid and is bendable along with the lid in such a manner that the remaining lip portion serves as the handle and facilitates manipulation of the spoon bowl. The lid covering and the base of the spoon bowl flap are foldable upon themselves with the covering encompassing the base in order to enhance structural rigidity. By way of contrast however the Tobiasson teaching does not lend itself readily to manipulation by unskilled hands, nor is it provided with a diametrically extending weakened area which allows a deformation once made to remain prior to subsequent realignment, so as to provide an eating utensil which when utilized does not require constant pressure along the lid area to cause the utensil to deform to a useful configuration during the dispensing process.

Similarly, the patents to Ruff teach the use of a container lid which is convertible into a scoop, in which the lid itself is capable of deformation in a specified manner so as to provide a utensil that is readily deployable. However, in reviewing the prior art of Ruff, particularly the earlier patent, difficulties exist in using a paperboard lid in so far as training the populous most likely to use the device i.e. children into deforming the lid in a proper fashion to provide a facile utensil. It is not seen how the improvement defined by the successive Ruff patent remedies these deficiencies in a manner as elegant as the instant application nor is it seen how this device according to Ruff provides concomitant benefits which are associated with the instant application as will now be defined.

By way of contrast, the instant application is directed to and claims a combined lid and eating utensil associated therewith which is provided with a hinge and score line along the intersection of the utensil and the lid on a bottom face thereof adapted to allow the utensil to be rotated along the hinge area and deployed outwardly of the lid, a score line running along a diameter of the utensil and the lid whereby deformation of the lid causes a corresponding deformation in the handle such that when thusly deployed, a utensil for dispensing material disposed within the container is capable of being incrementally extracted therefrom, but should the user decide to not dispense all of the contents at one sitting, the lid and utensil combination can be reoriented back to its original configuration and placed on the container without compromising the integrity of the seal of the container-lid interface.

SUMMARY AND OBJECTS OF THE INVENTION

Accordingly, it an object of this invention to provide a device which is capable of being deployed to dispense material preferably disposed within the container, the utensil-lid associated therewith being suitably fashioned to allow repositioning thereof on the container without disturbing the capability of the lid to sealingly engage the container.

It is yet a further object of the invention to provide a device of the character described above which is relatively inexpensive to manufacture, extremely durable in construction, safe to use, and readily understandable even by people who are not especially tactilely gifted.

It is still a further object of the invention to provide a device of the character described above in which the freshness of the articles disposed within the container are not compromised even when subsequent openings and closings are effected, given deformation of the lid to provide a utensil for dispensing.

It is still a further object of the invention to provide a device of the character described above which is deformed in such a manner that the outer face of the lid is the grasping area of the person using the device so that there is decreased likelihood that the contents disposed within the container will be touched by the hands of the user.

It is still a further object of this invention to provide a device of the character described above in which the flap hinged to the bottom face of the container is suitably constructed to provide a reliable eating utensil capable of withstanding usage as an eating utensil during the consumption of the entire contents within the container.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
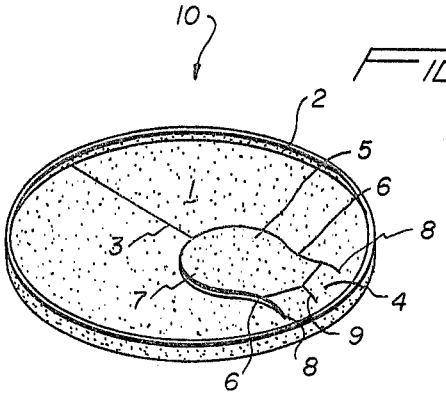
FIG. 1 is a perspective view of the bottom portion of the lid according to the present invention.
Figure 2:
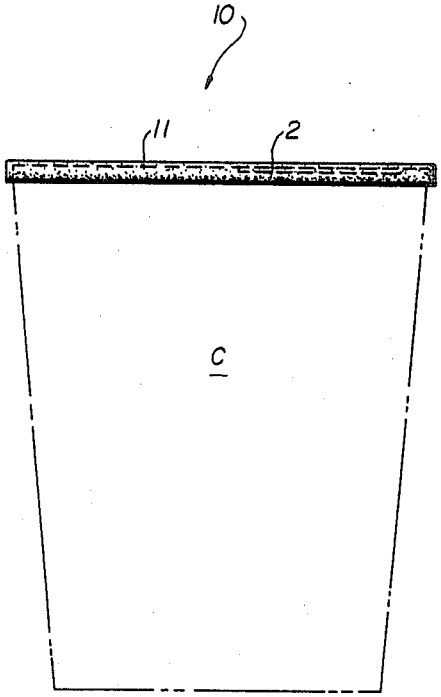
FIG. 2 is a side view of the lid of FIG. 1 showing its disposition on top of a container.

Referring to the drawings now wherein like reference numerals refer to like parts throughout the various drawing figures, reference numeral 10 is directed to the container lid including an integral spoon according to the present invention.

The lid 10 is shown as having substantially planar top and bottom surfaces, 11 and 1 respectively and a lip 2 which depends around the periphery of the lid, suitably fashioned to frictionally engage a top edge of the container C.

The drawings reveal a score line 3 extending diametrically along the length of the lid and suitably disposed so as to be coaxial with the utensil 5 described hereinafter. The utensil 5 is provided with a hinge area 4 so as to be integrally formed with the bottom surface of the lid, and the utensil 5 has a bottom base terminus 8 at which point the hinged area extends from one base edge 8 to another. Thereafter, the utensil tapers inwardly as at 6 and has a terminal portion defined by an arcuate edge 7 which defines the leading edge of the utensil when deployed. The score line for the utensil bears the reference numeral 9 and once the utensil portion 5 is rotated around hinge 4, the deformation of the lid along the score line 3 and the utensil 5 along line 9 provides a receding area capable of accepting the contents of the container C along the downwardly inclined areas which extend from score lines 3, 9. Additional "V" creases 12 extending from an end of the short score line 9 out to the tapered areas 6 cause the leading edge 7 of the spoon to flatten out somewhat to form a more conventional utensil.

Figure 3:
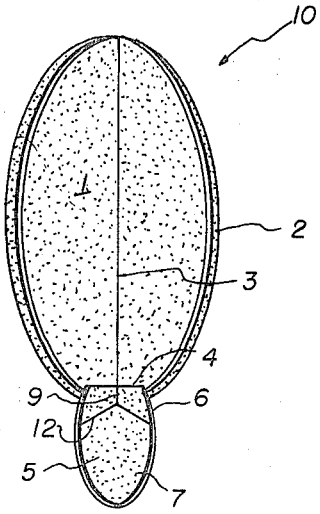
FIG. 3 is a plan view of the underside of the lid showing the eating utensil in a deployed condition and the lid suitably deformed to provide an eating utensil.
Figure 4:
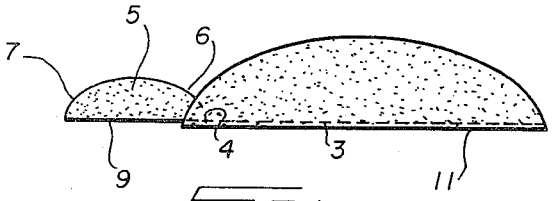
FIG. 4 is a side view of that which is shown in FIG. 3.

It is to be noted and shown especially well in FIGS. 3 and 4 that when the utensil 5 is suitably deployed, the utensil base edge 8 comes into proximate relation with the depending lip 2 so as to form a cantilever support area thereby providing additional support and rigidification of the utensil so as to handle foodstuffs of varying viscosities.

In use and operation therefore, the lid is removed from the container C and the utensil portion 5 is bent outwardly away from the bottom surface 1 of the lid 10 along the hinge line 4, so that a face of the utensil abuts against a portion of the lip 2. Thereafter, the lid and utensil are simultaneous defomed along the score lines 3, 9 so that a trough area is provided in both the lid and the utensil, the deformation being such that the top portion 11 of the lid 10 serves as the hand grasping area. This is extremely desirable since in this manner contents which tend to migrate and affix themselves to the underside of the lid 1 will not soil one's hand in the utilization of the device according to the present invention. Additionally, however the interaction of the lip 2, the cantilever structure caused by the abuttment 8 in combination with the narrowed area 6 and the arcuate utensil leading edge 7 provides an intrinsically self supporting and rigid structure that lends itself to removing the entire contents of the container as should now be evident.

The lid according to one preferred form of the invention is formed from a plastic material having sufficient resiliency and memory so that once deformed along the score line area, the lid can return to its original configuration so as to provide a positive seal on the container, should all the contents contained therewithin not be dispensed at one time. Moreover, it should be appreciated that the score lines provide an area of ready deformation, but is not extensive to the top surface 11 of the lid so that should the lid be redeployed upon the container, air will not be admitted along the score line area so that the freshness of the contents in the container is not compromised at any time.

Moveover, having thus described the invention, it should be apparent that numerous structural modification are contemplated as being part of this invention as set forth hereinabove and as defined hereinbelow by the claims.

what is claimed is:

1. A deformable container-lid including a spoon integral therewith comprising in combination:

a lid having substantially planar top and bottom surfaces and a depending perimeter lip adapted to sealingly engage a container, a tab member formed to serve as an eating utensil folded by a hinge on said bottom surface of said lid inboard of said lip whereby said utensil is adapted to be folded from a stored position parallel to and underlying said bottom lid surface to a hinged outwardly deployed position extending beyond said lip, said tab member having crease and score lines thereon to assist deformation, said lid and hinge formed from a resilient material having a memory whereby said lid and hinge can be respectively deformed and deployed to dispense material within said container with said utensil, and thereafter restored to an original condition for storage of a portion of the material in the container.

2. The device of claim 1 wherein a diametrically disposed first score line is provided on the entire length of said bottom surface of said lid so as to assist in the deformation.

3. The device of claim 2 wherein a second said score line is provided on said tab member defining said eating utensil, along a portion of the longitudinal length thereof adjacent said hinge, coaxial with said first score line on said lid whereby said utensil area is similarly deformed with said lid is bent.

4. The device of claim 3 wherein a portion of said utensil abuts against said lip when deployed as an eating utensil so as to provide a form of cantilevered support.

5. The device of claim 5 wherein both said score lines are disposed in such a manner as to encourage the deformation of said lid and said utensil so that said bottom surface of said lid is concave in shape, thereby providing said top surface as a grasping area for said utensil to allow one's hands to remain uncontaminated by the contents in the container.

6. The device of claim 6 where said utensil includes a narrowed utensil area proximate to said utensil hinge area, and an arcuate utensil leading edge area so as to facilitate in the dispensing of contents within the container.

7. The device of claim 6 wherein said crease line is a "V" crease from an end of said tab member second score line to said narrowed utensil area so as to flatten said leading edge.

* * * * *